United States Patent [19]

McSparran

[11] 4,423,296

[45] Dec. 27, 1983

[54] SHOCK AND VIBRATION RESISTANT ELECTRICAL SWITCH

[75] Inventor: Joseph F. McSparran, Cherry Hill, N.J.

[73] Assignee: RCA Corporation, New York, N.Y.

[21] Appl. No.: 350,089

[22] Filed: Feb. 18, 1982

[51] Int. Cl.[3] ..... H01H 3/60

[52] U.S. Cl. ..... 200/67 A; 200/288; 200/153 D

[58] Field of Search ..... 200/63 R, 63 A, 155 R, 200/155 A, 153 D, 67 A, 67 R, 288

[56] References Cited

U.S. PATENT DOCUMENTS

| | | | |
|---|---|---|---|
| 1,177,948 | 4/1916 | Haskins | 200/153 D |
| 1,657,338 | 1/1928 | Anderson | 200/155 R |
| 2,438,373 | 3/1948 | Oppel | 200/169 |
| 3,163,727 | 12/1964 | Eshleman | 200/67 R |
| 3,281,552 | 10/1966 | Tennant | 200/63 R |
| 3,308,256 | 3/1967 | Carlyle | 200/114 |
| 3,632,935 | 1/1972 | Stegmaier | 200/155 R |
| 4,103,126 | 7/1978 | DeNigris et al. | 200/67 |

FOREIGN PATENT DOCUMENTS

| | | | |
|---|---|---|---|
| 503573 | 10/1927 | Fed. Rep. of Germany | 200/153 D |

*Primary Examiner*—James E. Bryant, III
*Assistant Examiner*—Ernest G. Cusick
*Attorney, Agent, or Firm*—Joseph S. Tripoli; Robert L. Troike; William Squire

[57] ABSTRACT

First and second counterbalanced contact elements rotate about a common axis so that shock and vibration induced loads produce negligible moments on the contact elements with respect to their axis of rotation. Springs are included and arranged for snap opening and closing of the contact elements to minimize electrical arcing during opening and closing of the contacts.

9 Claims, 6 Drawing Figures

Fig. 1
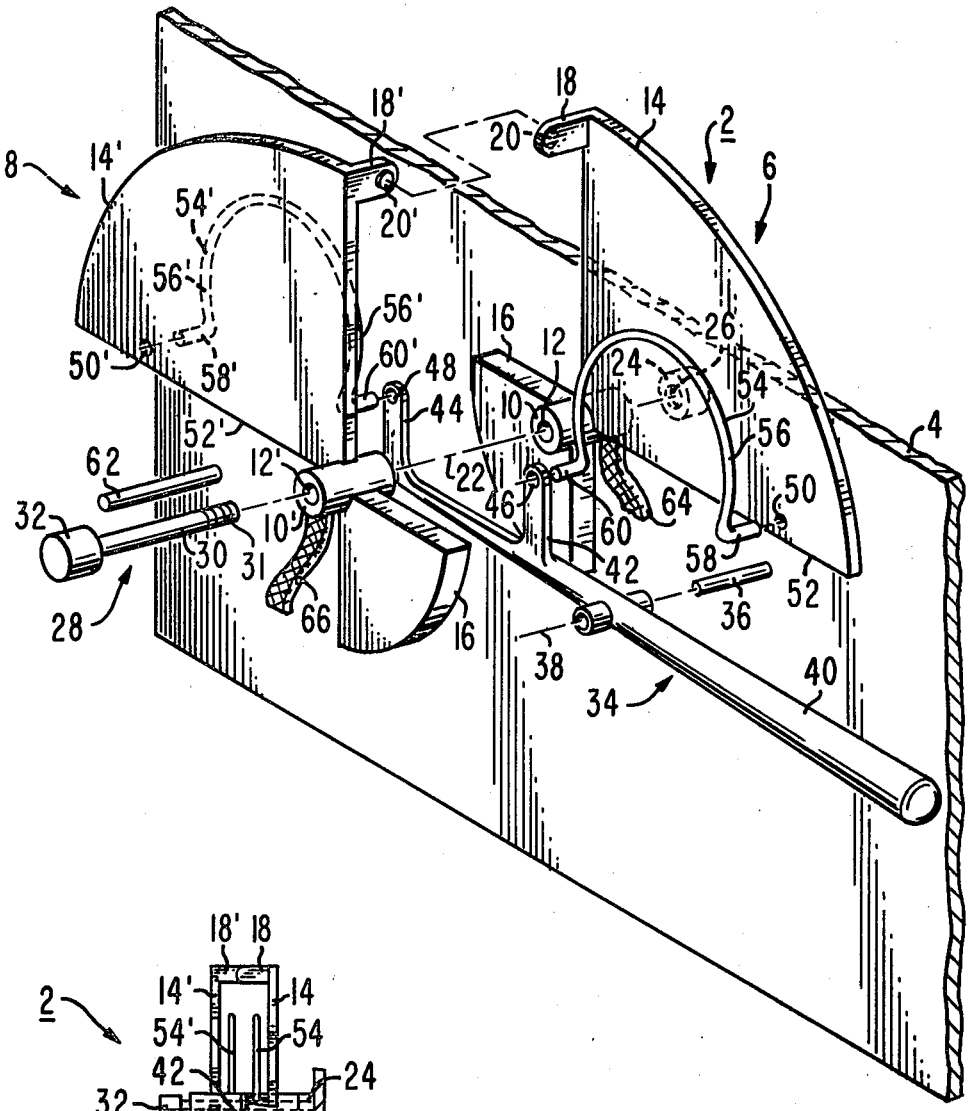
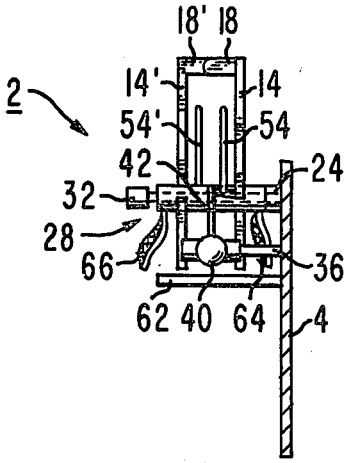
Fig. 2

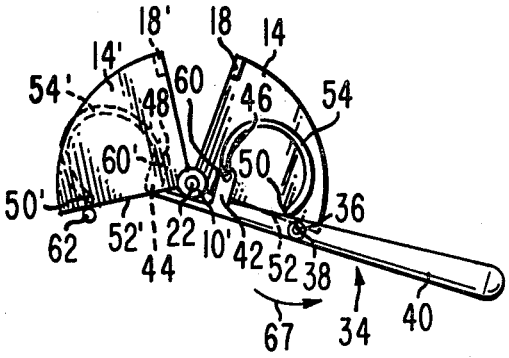
Fig. 3
Fig. 4
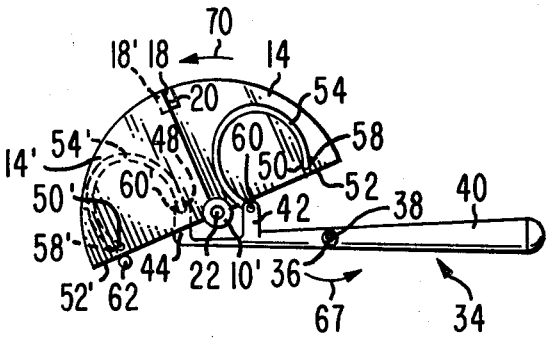
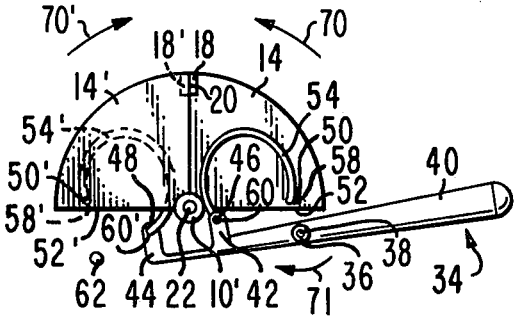
Fig. 5
Fig. 6
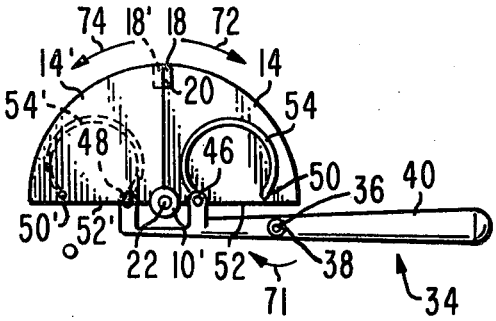

SHOCK AND VIBRATION RESISTANT ELECTRICAL SWITCH

The present invention relates to electrical switches and more particularly to an electrical switch which remains in the condition in which it is set, whether open or closed, even when subjected to mechanical shock or vibration.

A conventional mechanically operated switch includes one or more fixed and one or more movable electrical contacts. When such a switch is subjected to mechanical shock, its movable contact(s), if initially engaged with its fixed contact(s), may be momentarily jarred open. This causes interruption of power through the switch which, of course, is undesired. To overcome this problem, the spring tension of switches has been increased but this increase of tension causes more severe contact bounce and stiffer switch operation.

Another problem with ordinary switches is their relatively low switching speeds. When high currents are controlled, electrical arcs are generated during switch opening. This results in premature contact failure due to arc pitting. Stiffer springs have been used to increase the switching speed; however, as mentioned above, this increases contact bounce which is undesirable and also makes the switch more difficult to operate.

A switch embodying the present invention has both contacts rotatably secured and balanced so that the axis of rotation passes through the mass center of gravity of each of the contacts. As a result, moments about the axis of rotation for each contact induced by mechanical shock loads are equal and therefore balanced.

IN THE DRAWING

FIG. 1 is an isometric view of a switch in accordance with one embodiment of the present invention;

FIG. 2 is an end elevation view of the embodiment of FIG. 1; and

FIGS. 3–6 are fragmented elevation views of a switch embodying the present invention to illustrate different states of the switch.

In FIGS. 1 and 2, the movable elements of switch 2 are rotatable about axis 22. These elements are pivotally secured to a support plate 4 which may comprise a housing of the apparatus to which the switch 2 is to be electrically connected or other supporting structure. Switch 2 includes two vane assemblies 6 and 8 which may be identical in construction. Vane assembly 6 includes a hub 10 having a shaft bearing aperture 12. A contact vane 14 is secured to the hub 10. A counterbalance vane 16 is secured to hub 10 diametrically opposite the vane 14. Vane 14 may comprise a sheet metal or other electrically conductive sheet material formed as a quadrant or other segment of a circular disc. Contact tab 18 may be part of the vane 14 and bent to be normal to the plane of the vane 14. The contact tab 18 has a contact surface 20 on the far side.

The counterbalance vane 16, which may be smaller in dimensions but of a thicker and heavier metal than the vane 14, in combination with the vane 14 have a combined mass center located on the hub 10 axis of rotation 22. Vane 16 may also be a quadrant of a circular disc of metal, as shown. Vane assembly 8 being a mirror image of the vane assembly 6 has its elements which are similar to the elements of assembly 6 identified with the same numbers, but primed. Boss 24 is secured to plate 4 and includes a threaded aperture 26. Threaded shaft 28 has a bearing shaft 30 and an end cap 32 and rotatably secures the vane assemblies 6 and 8 to the support plate 4 via hubs 10, 10'. The bearing shaft 30 of the shaft 28 is passed through the apertures 12, 12' of the respective hubs 10, 10' and is threaded at threads 31 to the boss 24 threaded aperture 26. The cap 32 retains the hubs 10 and 10' on the bearing shaft 30.

Actuating lever 34 is pivotally mounted to pin 36 which is secured to support plate 4. The lever 34 rotates about axis 38. Axis 38 is parallel to axis 22. Lever 34 comprises an arm 40 and two legs 42 and 44 extending in the same direction from arm 40.

Leg 42 has an aperture 46; and leg 44 has an aperture 48. Vane 14 has an aperture 50 closely spaced to edge 52 of the vane. The vane 14' has an aperture 50' closely spaced to edge 52'. The position of the pin 36 with respect to the axis 22 and to the apertures 50, 50' and 46, 48 is such that when the switch is in one closed orientation, that is, with the contact surfaces 20, 20' in engagement, the axis 22, aperture 46, and aperture 50 lie on one radial line and the aperture 50', aperture 48, and the axis 22 lie on a second radial line as shown in FIG. 6.

The vane assembly 6 is resiliently secured to the leg 42 by spring 54. Spring 54, formed of spring wire, includes a body portion 56 which is horseshoe shaped and slightly skewed in a somewhat spiral configuration. Leg 58 of spring 54 is at one end of the body portion 56 and a leg 60 is bent from the other end of the body portion 56. The leg 58 is in the aperture 50 and the leg 60 is in the aperture 46. Similarly, spring 54', which may be identical to spring 54, has a body portion 56' and two legs 60' and 58' which are respectively in apertures 48 and 50'.

Pin 62 is secured to the support plate 4 at a position adjacent edge 52' of contact vane 14'. The pins 36 and 62 act as stops, limiting the travel of the respective vanes 14, 14' when the vanes are rotated to an opened position, FIG. 3.

Secured to hub 10 is an electrical connecting strap 64 which may be braided copper or similar material. Connected to hub 10' is a connecting strap 66 of braided copper or similar material. Straps 64 and 66 electrically connect the contacts 18 and 18' to circuits (not shown) of which the switch 2 is part. It is to be understood that all of the parts included in the vane assemblies 6 and 8 are made of metal to provide good electrical conduction between the contacts 18, 18' and the respective conductor straps 64, 66. Pins 36 and 62, boss 24, and shaft 28 are electrical insulators.

The masses of the vanes 14 and 14' are counterbalanced by the masses of the corresponding counterbalancing vanes 16 and 16' so that moments introduced by shocks and vibrations, that is, by rapid accelerations of the vane structures in response to shock and vibration loading are equal and opposite in direction about the axis 22 for each of the vane assemblies 6 and 8. As a result, little or no rotary motion of the vane assemblies 6 and 8 is induced by such shock and vibrations. This is an important feature in that whether the contacts 18, 18' are in the engaged closed position or the disengaged switch open position, no moments tending to reverse their position from a disengaged to an engaged state or from an engaged state to a disengaged state is induced by such shock and vibration accelerations. The springs 54, 54' need not be made of heavy duty material due to the absence of significant moments resulting from such shock loads.

In FIGS. 3–6 counterbalance vanes 16, 16′ (FIG. 1) are omitted for simplicity of explanation. It is to be understood that these counterbalance vanes, in practice, are present on the structure of FIGS. 3–6. An important feature also present in the present embodiment is that the springs 54, 54′, due to their relative position with respect to the lever arm 34 and the vanes 14 and 14′, provide rapid switch action and perform as a snap action switch. This rapid switch action tends to minimize arcing between the contact surfaces 20 and 20′, FIG. 1, when the switch contacts are opened or closed.

FIGS. 3–6 show different positions of the switch as a function of the action of the lever arm 40, the lever arm 40 being pivoted about axis 38 to operate the switch. For example, in FIG. 3 the lever arm has been rotated clockwise to open the switch. The contacts 18 and 18′ are separated; the edge 52 of contact vane 14 rests on pin 36 and the edge 52′ of contact vane 14′ rests on pin 62. The pins 36, 62 act as stops limiting the distance traveled by the vanes 14 and 14′ to their open position.

To close the switch, lever 34 is rotated counterclockwise in direction 67 about axis 38. In the orientation of FIG. 3, the leg 60 of spring 54 (FIG. 1) is spaced above a radial line between axis 22 and leg 58 and leg 60′ of spring 54′ above a radial line between axis 22 and the other leg 58′. As the arm 40 is rotated counterclockwise the legs 60, 60′ are moved downward. Relative to the movement of leg 60, the radial line between 22 and 58 represents the dead center position of the switch. When the leg 60 passes just beyond this radial line, the switch snaps into the position shown in FIG. 4. The movement of leg 60 of the spring to the position shown has caused the vane 14 to rotate counterclockwise, as indicated by arrow 70. The contact 18 now engages the contact 18′. The vane 14′ remains in the same position as in FIG. 3 abutting pin 62 at edge 52′. At this point the leg 60, is below the radial line between axis 22 and leg 58 and leg 60′ is above the radial line between axis 22 and leg 58′.

Continuing to rotate the lever counterclockwise (direction 67) maintains the contacts closed and increases the torque created by the springs 54, 54′. This is shown in FIG. 5. As the leg 60′ of spring 54′ is moved further down, the action of spring 54′ tends to cause the leg 58′ to move upward and to rotate the vane 14′ clockwise (direction 70′). In response to the counterclockwise movement of arm 40, the leg 60 of spring 54 also moves down but not as far as the leg 60′ of spring 54′. This downward movement tends to rotate vane 14 counterclockwise (direction 70); however, the counterclockwise torque on vane 14 is smaller than the clockwise torque on vane 14′. The overall result therefore is to rotate both vanes clockwise to the position shown in FIG. 5, while the two contacts 18, 18′ remain in very firm engagement. Further, counterclockwise movement of lever arm 40 will cause the edge 52 of vane 14 to rest against pin 36 which stops the movement of the vanes 14, 14′ about axis 22.

To open the contacts, the lever 34, arm 40, is rotated in the clockwise direction 71, FIG. 5, about axis 38. This tends to rotate the lever legs 42, 44 in direction 71 until the legs 60, 60′ of the respective springs 54, 54′ are aligned with the radial line passing through the axis 22 and the other ends of the springs at legs 58, 58′. When the two legs 60, 60′ of the springs move just past this, the dead center position of the switch, then the switch snaps open and assumes the condition shown in FIG. 3. In FIG. 6 the contacts 18, 18′ are still closed but further rotation of the lever arm 40 in direction 71 from the position of FIG. 6 tends to snap the contacts 18, 18′ open to the position of FIG. 3.

While the above action has been described in a sequence of steps, it is to be understood that manual movement of the lever is relatively fast in the matter of a fraction of a second and that the action of the switch contacts in opening and closing is also in a fraction of a second, providing a snap action in opening and closing the contacts and therefore minimizing arcing which may result during the opening and closing.

While the structure of the present embodiment is shown in the form of vanes, it should be understood that this is by way of example, as other counterbalanced contact elements may be readily constructed in other shapes and forms. An important consideration is that the contact elements be balanced with respect to their axis of rotation so that negligible moments are introduced as a result of acceleration induced forces in the presence of vibrations and shock induced loads. Because the contacts are balanced, they tend to remain in position whether open or closed and without the need for heavy duty springs.

What is claimed is:

1. An electrical switch comprising:

first and second contact elements, each being secured for rotation about a first axis passing through the center of gravity of that element so that said elements tend to remain stationary in the presence of vibration and shock loads applied to said elements in a direction normal to said axis, said elements each including an electrical contact, said elements being positioned so that when rotated about said axis, their respective contacts engage in a closed switch state and disengage in an open switch state; and means for selectively placing the contacts in said closed and open states, said means for selectively placing including spring means attached to said elements, said spring means including a pair of springs and a lever secured for rotation about a second axis parallel to said first axis, each spring being attached to said lever, one of said springs being attached to one of said elements and the other spring being attached to the other of said elements, said springs and lever being positioned so that rotation of said lever about said second axis causes said elements to be rapidly placed in said states.

2. The switch of claim 1 wherein said elements comprise identical structures.

3. The switch of claim 1 wherein said elements each comprise a contact vane segment to which its contact is secured and a counterbalancing vane segment which substantially counterbalances the mass of said contact segment about said axis, said segments being attached to a central hub element diametrically opposite each other.

4. The switch of claim 1 wherein said elements are of like construction, each element comprising a hub portion including shaft means about which the hub portion rotates and a contact portion secured to the hub portion, said contact portion having its center of gravity lying on the axis of rotation of said hub portion so that an acceleration of said switch produces negligible torques on said elements about said axis.

5. An electrical switch comprising:

a support;

a shaft secured to the support;

a first contact element secured for rotation about the shaft;

a second contact element secured for rotation about the shaft and adapted to engage the first element in a closed switch state;

each said element having its center of mass lying on the axis of rotation through said shaft; and spring means secured to said elements and rotatably secured to said support for rotation about a second axis for moving the elements to either a closed state or an open state in accordance with the angular position of said spring means with respect to said second axis.

6. The switch of claim 5 wherein each contact element comprises a sheet material vane portion and a contact tab member secured to the vane portion, a counterbalancing element, and a hub portion mounted on the shaft and secured between the latter element and vane portion.

7. The switch of claim 5 wherein said spring means comprises first and second horseshoe-shaped spring members, one end of each member being secured to a different corresponding contact element, and a lever having a forked portion, the other end of each spring member being secured to a different corresponding leg of the forked portion, the connection of said springs to said contact elements and to said forked portion lying on corresponding respective radial lines through said axis of rotation when the elements are engaged, said lever being movable about said second axis so that said connections of said springs to said legs displace from said radial lines in accordance with the desired state of said switch.

8. An electrical switch comprising:

first and second contact elements, each being secured for rotation about an axis passing through the center of gravity of that element so that said elements tend to remain stationary in the presence of vibration and shock loads applied to said elements in a direction normal to said axis, said elements each including an electrical contact, said elements being positioned so that when rotated about said axis, their respective contacts engage in a closed switch state and disengage in an open switch state, said elements being of like construction, each element comprising a hub portion including shaft means about which the hub portion rotates and a contact portion secured to the hub portion, said contact portion having its center of gravity lying on the axis of rotation of said hub portion so that an acceleration of said switch produces negligible torques on said elements about said axis; and means for selectively placing the contacts in said closed and open states, said means for selectively placing including spring means attached to said elements, said spring means including a pair of springs and a lever, each spring being attached to said lever, one of said springs being attached to one of said elements and the other spring being attached to the other of said elements, said springs and lever being positioned so that rotation of said lever relative to said axis causes said elements to be rapidly placed in said states.

9. An electrical switch comprising:

a first contact element secured for rotation about its center of gravity;

a second contact element secured for rotation about its center of gravity;

means for rotatably securing the contact elements for rotation about an axis passing through said centers of gravity;

said elements being placed in conductive contact when rotated to a first position and opening when rotated to a second position; and spring means for urging the elements in said first and second positions, said spring means including a first spring secured to the first element, a second spring secured to the second element, and a lever secured to both said springs, said elements, springs, and lever being arranged with the lever secured to the springs so that rotation of the lever about an axis parallel to said axis causes said springs to apply oppositely directed torques to said elements regardless the direction of rotation of said lever, the rotation of the lever in one direction creating a pair of torques in one set of directions and rotation of the lever in a direction opposite the one direction creating a second pair of torques opposite the one set of directions.

* * * * *